US005132625A

United States Patent [19]

Shaland

[11] Patent Number: 5,132,625

[45] Date of Patent: Jul. 21, 1992

[54] DISTRIBUTORLESS IGNITION ADAPTER FOR DIAGNOSTIC OSCILLOSCOPES

[75] Inventor: Alexander Shaland, Lyndhurst, Ohio

[73] Assignee: Actron Manufacturing Company, Cleveland, Ohio

[21] Appl. No.: 591,625

[22] Filed: Oct. 1, 1990

[51] Int. Cl.[5] ..... F02P 17/00

[52] U.S. Cl. ..... 324/392; 324/380; 324/391; 324/402

[58] Field of Search ..... 324/379, 380, 391, 392, 324/402

[56] References Cited

U.S. PATENT DOCUMENTS

| | | | |
|---|---|---|---|
| 3,221,545 | 2/1962 | Traver | 73/116 |
| 3,789,658 | 2/1974 | Olsen | 73/117.3 |
| 3,891,917 | 6/1975 | Harris | 324/382 |
| 3,979,664 | 9/1976 | Harris | 324/397 |
| 4,101,822 | 7/1978 | Does et al. | 324/16 R |
| 4,366,436 | 12/1982 | Everett et al. | 324/379 |
| 4,379,263 | 4/1983 | Everett et al. | 324/379 |
| 4,396,888 | 8/1983 | Everett et al. | 324/379 |
| 4,644,284 | 2/1987 | Friedline et al. | 324/397 |
| 4,795,979 | 1/1989 | Kreft et al. | 324/379 |
| 4,847,563 | 7/1989 | Sniegowski et al. | 324/402 |
| 4,937,527 | 6/1990 | Sniegowski et al. | 324/402 |

FOREIGN PATENT DOCUMENTS

| | | |
|---|---|---|
| 0272225 | 6/1988 | European Pat. Off. . |
| 3325308A1 | 1/1985 | Fed. Rep. of Germany . |
| WO89/08778 | 9/1989 | PCT Int'l Appl. . |

OTHER PUBLICATIONS

Dialog Abstract re German Patent No. DE 3325308 A1 Jan. 1985.

Radio Electronics Vol. 56, Jul., 1985, pp. 55-57, 82.

The Giant Book of Easy to Build Electronic Projects (Tab Books, Inc. 1981).

Kal-Equip Model 2880 10 MegOhm Digital Multimeter.

The Allen Graoup 32-470 Distributorless Ignition Adaptor Operation Guide.

Sun Electric Corporation Engine Analyzer Model DIL 200.

Kal-Equip Catalog pp. 3-4.

*Primary Examiner*—Kenneth A. Wieder
*Assistant Examiner*—Glenn W. Brown
*Attorney, Agent, or Firm*—Calfee, Halter & Griswold

[57] ABSTRACT

An ignition adapter for DIS four stroke engines provides conventional voltage waveforms for a diagnostic oscilloscope. Spark plug leads from a DIS four stroke engine are grouped together depending on their respective firing polarity. A first signal pickup is placed around the spark plug leads from the spark plugs of one signal polarity, for example a positive signal polarity, and a second signal pickup is placed around the spark plug leads from the spark plugs of opposite polarity, for example a negative signal polarity. A trigger pickup is placed around the #1 cylinder spark plug lead. The voltage waveforms received in the signal pickups are applied to the ignition adapter, summed and displayed on the oscilloscope as a conventional voltage waveform. The polarity of the waveform can be reversed using a polarity switch. The waveform received in the trigger pickup is applied to the ignition adapter and compared to a reference voltage. When the waveform exceeds the reference voltage, a voltage pulse is applied to the oscilloscope as a trigger pulse. The ignition adapter includes a trigger adjust that can be set to trigger the oscilloscope on the higher voltage levels present during the compression stroke of the DIS four stroke engine, thereby to emulate a conventional voltage waveform.

18 Claims, 4 Drawing Sheets

3 4A 4B

DISTRIBUTORLESS IGNITION ADAPTER FOR DIAGNOSTIC OSCILLOSCOPES

The present invention relates to an ignition adapter for DIS four stroke engines to provide conventional voltage waveforms for diagnostic oscilloscopes. More particularly, the invention relates to variably selecting the voltage trigger threshold from the #1 spark plug lead to provide a conventional voltage waveform on a diagnostic oscilloscope for DIS four stroke engines.

BACKGROUND

Ignition adapters are typically used to adapt the spark plug firing patterns in a DIS four stroke engine to a voltage waveform for display on an oscilloscope. The voltage waveform is then used for diagnostic testing of the ignition system in the engine. In the DIS four stroke engine, the engine has a series of double-ended coils, where each coil fires two spark plugs simultaneously. Each coil is coupled through an ignition module to a timing circuit, which is generally included within an on-board computer. The timing circuit, through the ignition module, provides a voltage spike in the coil. When the voltage through the coil rises, a first spark plug fires on a compression stroke and ignites an air/fuel mixture in a first cylinder, while a second spark plug fires on an exhaust stroke but does not ignite an air/fuel mixture in a second cylinder.

Conventional diagnostic oscilloscopes are designed to display voltage waveforms for conventional four stroke engines, which sequentially fire a series of spark plugs. However, conventional oscilloscopes do not provide the proper waveform for DIS four stroke engines in part because of the above-mentioned design of the double-ended coils. Accordingly, conventional oscilloscopes must be modified, for example with an ignition adapter, to provide a proper voltage waveform for DIS four stroke engines.

The ignition adapter may comprise for example, an electronic circuit inserted between an on-board computer and the leads to the spark plugs, as shown in Friedline et.al. U.S. Pat. No. 4,644,284. The electronic circuit in Friedline is adapted to generate modified timing signals based on commands from an engine analyzer to fire the spark plugs. Friedline shows secondary signals from the #1, #3 and #5 spark plugs, and from the #2, #4 and #6 spark plugs separately received in the circuit, and converted to a voltage waveform for display on an engine analyzer. The circuit monitors the exhaust and compression stroke firings from the #1 spark plug in a first, inductive pickup, and monitors the compression stroke firings in the #1, #3 and #5 spark plugs in a second pickup. The signals are combined and trigger the engine analyzer on the firing of the spark plug during the compression stroke.

Additionally, Sniegowski et al U.S. Pat. No. 4,847,563 discloses a relatively complicated method of providing a conventional voltage waveform on an engine analyzer. A series of six pickups are attached to the spark plug leads to measure the spark plug firing patterns. Sniegowski initially determines the firing sequence for all cylinders and their corresponding signal polarities using a microprocessor. The spark plug leads are sorted depending on their polarity into a first group having negative waveforms, and a second group having positive waveforms. The first group signals are applied through a secondary output for display on an engine analyzer, while the second group signals are inverted before being displayed.

The Sniegowski circuit is triggered by a seventh inductive pickup placed around the #1 spark plug lead from the engine. The microprocessor is triggered during both the compression stroke and the exhaust stroke. The microprocessor divides by two the number of #1 signals generated, and applies the signals to the engine analyzer at the proper time during the secondary waveform parade.

The prior art ignition adapters attempt to provide conventional firing patterns for DIS engine diagnostic testing. However, the prior art circuits can require complicated electronics and many do not allow for flexible control of the trigger level to compensate for variable voltage levels in the circuit. Moreover, the prior art circuits can require cumbersome hookup procedures and significant expense in purchasing and maintaining the diagnostic equipment.

SUMMARY OF THE INVENTION

The present invention provides a new ignition adapter and associated circuitry for use with distributorless ignition systems. The ignition adapter and associated circuitry provides for displaying conventional voltage waveforms on a diagnostic oscilloscope. The ignition adapter includes relatively simple electronics and allows for the flexible control of the trigger level to compensate for variable voltage levels in the circuit. Additionally, the ignition adapter is relatively simple to hookup and inexpensive to purchase and maintain.

According to one aspect of the invention, the ignition adapter comprises an electronic circuit having a trigger pickup, signal pickups, power leads and oscilloscope leads. The ignition adapter further includes a polarity switch to provide proper ignition patterns on the oscilloscope, and a trigger adjust knob to provide a stable picture of the correct number of spark plug firings on the oscilloscope for DIS four stroke engines.

The power leads to the ignition adapter are connected to the positive and negative terminals of the vehicle battery to supply power to the ignition adapter. The signal pickups are placed around the spark plug leads from the engine to capacitively sense the voltage waveform in the leads. The trigger pickup is placed around the #1 cylinder spark plug lead to trigger the oscilloscope on the compression stroke of the #1 cylinder. The oscilloscope leads provide the oscilloscope with a conventional voltage waveform for diagnostic testing of DIS four stroke engines.

The spark plug leads from the engine are grouped together depending upon whether their respective spark plugs have the same firing polarity, e.g. a positive or negative firing polarity. The spark plug leads for cylinders with spark plugs having one signal polarity are grouped in a first signal pickup, and the leads from cylinders with spark plugs of opposite polarity are grouped in a second signal pickup. The actual firing polarity is unimportant since the polarity of the groups can be reversed using the polarity switch to provide the correct waveform polarity on the oscilloscope.

The signals received in the two signal pickups represent the positive and negative voltage waveforms, respectively. The signals are each buffered and fed to the positive and negative inputs of a differential amplifier, where they are then summed. The single output of the differential amplifier is amplified and applied to the oscilloscope screen as a conventional voltage waveform.

The oscilloscope is adapted to be triggered on the compression stroke of the #1 spark plug cylinder in the DIS four stroke engine. A trigger adjust knob allows variable selectivity of the threshold voltage received from the trigger pickup for triggering the oscilloscope. The knob allows the operator to select the relatively higher compression stroke voltage levels present in the #1 spark plug lead for triggering the oscilloscope.

Further features and advantages of the present invention will become apparent from the following detailed description and the accompanying drawings.

DETAILED DESCRIPTION OF THE PREFERRED EMBODIMENT

Figure 1:
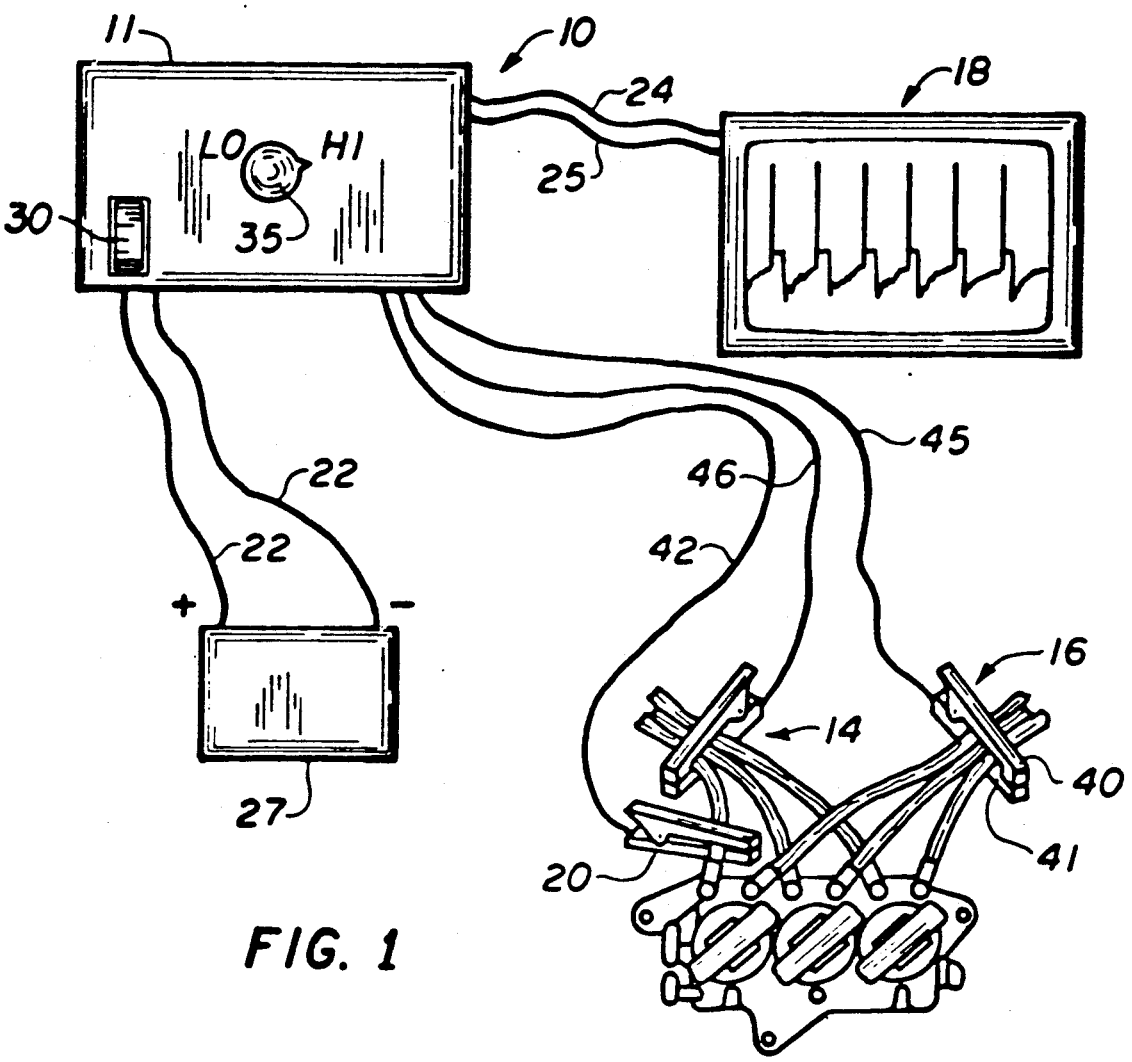
FIG. 1 is a perspective view of the ignition adapter schematically illustrating the trigger pickup, signal pickups power leads and the oscilloscope leads constructed according to the present invention.

Referring to the figures, and initially to FIG. 1, the ignition adapter provided by the present invention is indicated generally by reference numeral 10 and includes a conventional housing 11 enclosing an electronic circuit, indicated generally at 12 (illustrated in FIG. 2), as described herein in more detail. The ignition adapter includes two signal pickups, indicated generally at 14 and 16 respectively, and a trigger pickup 20. For a six cylinder car, the signal pickups are each clamped on three spark plug lead wires to cooperatively sense voltage levels in all the spark plug leads. The trigger pickup is clamped to the #1 spark plug lead wire to sense the voltage levels in the #1 spark plug lead. The ignition adapter also includes power leads 22 adapted to be attached to the terminals of the vehicle battery 28. The ignition adapter further includes oscilloscope output leads 24, 25 connected to the oscilloscope terminals for providing the oscilloscope with conventional voltage waveforms from the ignition adapter during spark plug firing in distributorless ignition system (DIS) engines.

Moreover, as described herein in more detail, the ignition adapter includes a polarity switch 30 and a trigger adjust knob 35 in contact with the electronic circuit. The polarity switch has two alternate positions which can be selected to provide the correct signal input to the oscilloscope. The trigger adjust knob is variable to provide a stable pattern with the correct number of spark plug firings on the oscilloscope.

An internal combustion engine typically has a series of pistons reciprocating within their respective cylinders. A four stroke engine has (1) an intake stroke, (2) a compression stroke (3) a power stroke and (4) an exhaust stroke. The cylinder pistons are in rotating engagement with a crankshaft, which provides power for movement of the vehicle.

On the intake stroke of the four stroke engine, the piston moves down the cylinder and creates a vacuum above it in the cylinder head. A camshaft, mechanically coupled to the crankshaft, causes an intake valve on the head of the cylinder to open and an exhaust valve to close. The intake valve delivers an air-fuel mixture from the carburetor to the respective cylinder. When the piston begins to move upward in the cylinder during the compression stroke, the intake valve closes and the fuel/air fuel mixture is compressed. When the piston nears the upper end of the cylinder, the spark plug fires and ignites the mixture. The rapid burning of the fuel forces the piston downward during the power stroke. At the bottom of the power stroke, the exhaust port opens and the exhaust gas flows out of the port, assisted by the upwardly moving piston on the exhaust stroke.

Later model engines can have a DIS four stroke engine. In the DIS four stroke engine, the engine has a series of ignition coils. The secondary windings of the coils each have two ends, wherein each end is connected to a spark plug. The primary windings of the coils are coupled through an ignition module to a timing circuit in an on-board computer. Current flowing in the primary windings causes electro-magnetic lines of force to cut across the secondary windings of the costs. A sudden collapse of current in the primary windings causes by the ignition module creates an induced voltage in the secondary windings, and thus provides a voltage spike to the spark plug gap in both spark plugs. The first spark plug on the secondary windings fires normally in a first cylinder that is on a compression stroke and ignites an air/fuel mixture, while the second spark plug simultaneously fires a "waste spark" in a second cylinder that is on an exhaust stroke, but does not ignite an air/fuel mixture.

The level of voltage supplied to a spark plug to cause it to fire is a function of the dielectric strength in the spark plug gap. In a DIS four stroke engine, when the cylinder is under compression, the dielectric strength in the spark plug gap is high, and consequently a substantial voltage is required to ignite the spark plug, typically in the 15 kilovolt range. However, when the cylinder across the spark plug gap is lower and the spark plug fires at a relatively low voltage, typically in the 1.5 kilovolt range.

The two signal pickups 15, 16 are adapted to be placed around the spark plug leads to capacitively sense the voltage in the leads. For example, in a sic cylinder engine, as illustrated in FIG. 1, three ignition coils having six leads provide voltage spikes to six spark plugs in the engine. The two signal pickups are each clamped around three spark leads from the engine. The first signal pickup 114 is clamped around three spark plug leads that are connected to spark plugs that have the same signal polarity, for example a positive firing sequence. The second signal pickup 16 is clamped around three spark plug leads that have the opposite signal polarity, for example a negative firing sequence. However, this invention is not limited to six cylinder engines, rather the same principles apply to four or eight cylinder engines, wherein the two pickups will be clamped around two or four spark plug leads each.

When two spark plugs connected to the same coil are firing, the first signal pickup will, for example, initially sense the higher voltage levels that occur during the compression stroke of one cylinder, while the second signal pickup will initially sense the lower voltage levels that occur during the exhaust stroke of the companion cylinder. The voltage levels in the first and second pickups will reverse amplitude as the cycle progresses from compression to exhaust in the first cylinder, and from exhaust to compression in the companion cylinder.

Each signal pickup has two arms, for example as shown at 40, 41, adapted to be clamped around a respective group of spark plug leads from the engine. Each of the two arms includes a plate (not shown) pivotally mounted within the arms. These opposed plates cooperate to capacitively sense the voltage waveform in the leads. The plates are electrically connected together at the base and have a lead extending therefrom to the ignition adapter. In particular, lead 45 connects signal pickup 16 to the ignition adapter and lead 46 connects signal pickup 14 to the ignition adapter.

Additionally, the trigger pickup 20 is adapted to be clamped around a single spark plug lead, for example the #1 cylinder spark plug lead as shown in FIG. 1. The trigger pickup is similar in construction t the two signal pickups and is adapted to capacitively sense the voltage waveform in the #1 spark plug lead. The trigger pickup is connected to an input to the ignition adapter by lead 42.

Figure 2:
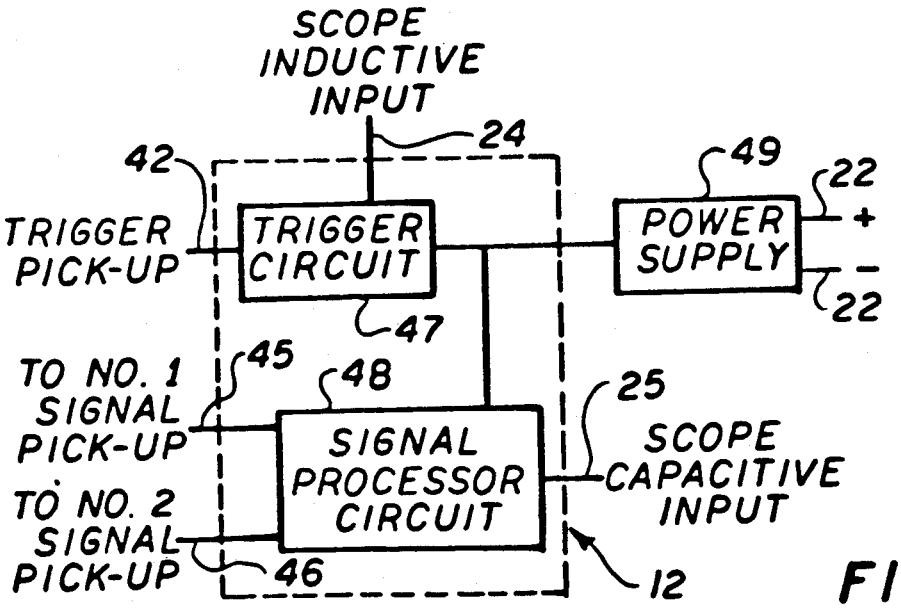
FIG. 2 is a schematic illustration of the electrical components of the ignition adapter constructed in accordance with the present invention.

As shown in FIG. 2, the electronic circuit 12 in the ignition adapter includes a trigger circuit, indicated generally at 47, and a signal processing circuit, indicated generally at 48. Both the signal processing circuit and the trigger circuit are electronically connected to a power supply indicated generally at 49.

The signal processing circuit provides a conventional voltage waveform for display on the oscilloscope, while the trigger circuit is adapted to trigger the oscilloscope on the #1 spark plug firing during the compression stroke in the engine. The power supply circuit is conventional in design is constructed as a CD to CD converter to isolate the ignition adapter from the vehicle battery and provide a variety of different DC voltage levels for the circuit. In particular, the power supply circuit provides separate −30 volt, +14 volt, +5.6 volt and −14 volt levels for the circuit.

Figure 4A:
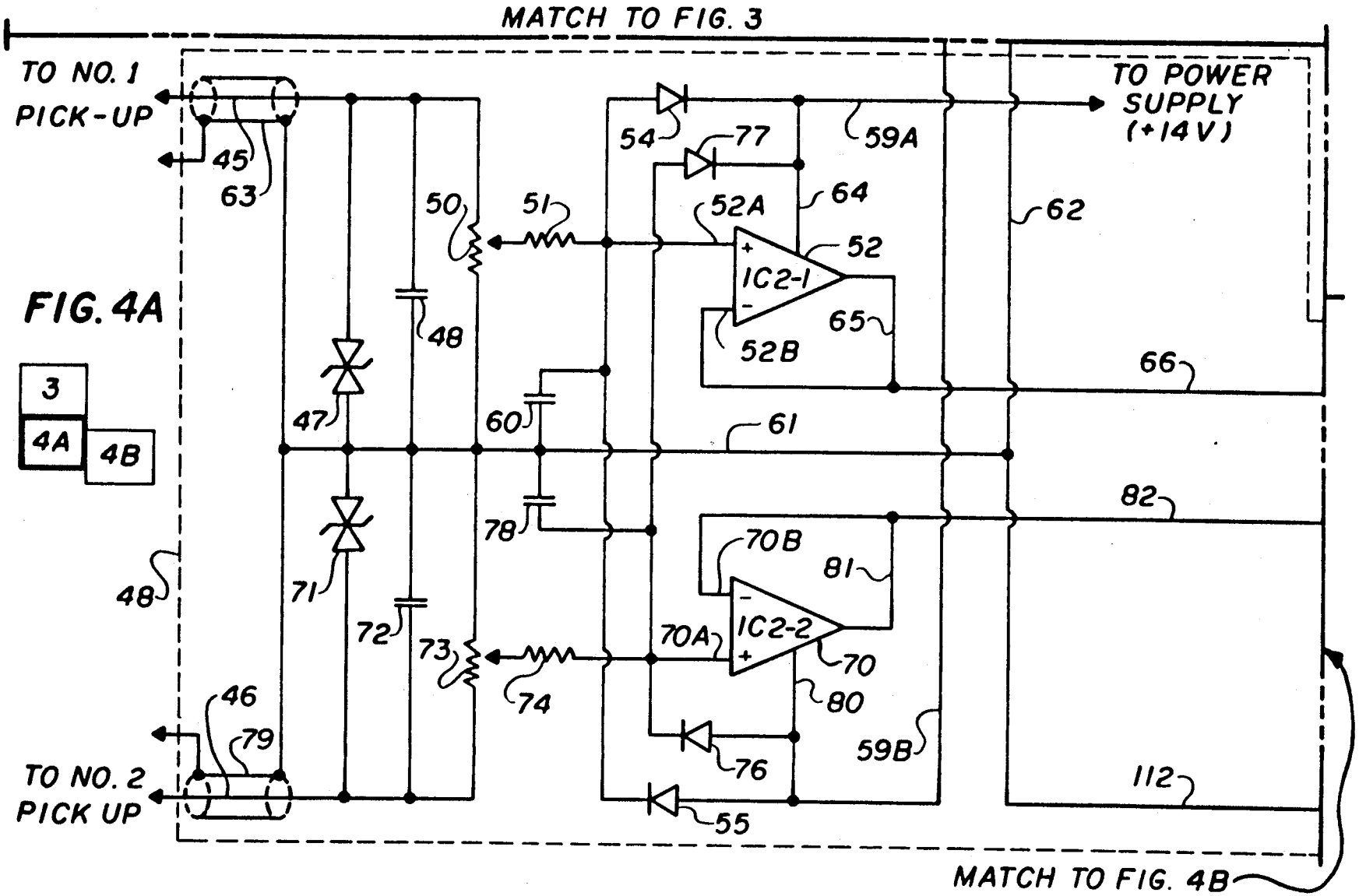
FIGS. 4A and 4B are electrical circuit diagrams matched together as shown to cooperatively illustrate the waveform generator circuit component of FIG. 2.

As shown in more detail in FIG. 4A, the lead 45 from the first signal pickup is applied to a first input to the signal processing circuit, and the lead 46 from the second signal pickup 16 is applied to a second input to the signal processing circuit. The input from each lead is applied to a buffer, for example, the positive input to an op-amp.

In particular, the input through lead 45 is initially applied in parallel across one end of movistor 47, capacitor 48, and variable resistor 50. The movistor 47 provides transient voltage suppression, while capacitor 48 provides filtering. Variable resistor 50 is initially calibrated during manufacturing to properly scale the voltage waveform to present a proper display on the oscilloscope.

The input is then applied to resistor 51, which, in conjunction with diodes 54, 55, acts as a current limiting device to protect op-amp 52. Diode 54 is connected in a forward bias direction between resistor 51, the positive input 52A to op-amp 52 and lead 59A to a positive supply voltage (+14 volt). Diode 55 is similarly connected in a reverse bias direction between resistor 51, the positive input 52A to op-amp 52 and lead 59B to a negative supply voltage (−14 volt). Finally, capacitor 60 provides low pass filtering for co-amp 52 and is connected to the positive input 52A to op-amp 52.

Lead 61 connects the other end of movistor 47, resistor 50 and capacitors 48, 60, and is connected to ground through lead 62. Lead 61 additionally is connected to and grounds shield 63 on lead 45.

Co-amps 52, 70 and 88 are formed on a conventional guard op-amp and are supplied through leads 64 and 59A with a positive supply voltage (+14v), and through leads 80 and 59B with a negative supply voltage (−14B). Op-amp 52 is connected as a conventional source follower to provide unity gain, high input impedance and low output impedance. The single output 65 from op-amp 52 is connected to the negative input 52B, and is also applied through lead 66 to the first contact of a polarity switch, indicated generally at 67 in FIG. 4B.

The input from lead 46 is connected in a similar arrangement as lead 45, and is applied to op-amp 70. Specifically, the input is initially applied in parallel across one end of movistor 71, capacitor 72, and variable resistor 73. Ground lead 61 is connected to the other end of movistor 71, capacitor 72 and variable resistor 73. Variable resistor 73 is similarly initially calibrated during manufacturing to properly scale the voltage waveform from display on an oscilloscope.

The input to variable resistor 73 is then applied to resistor 74, which, in conjunction with diodes 76, 77, protect op-amp 70. In particular, diode 76 is connected in a negative bias direction between resistor 74, the positive input 70A to op-amp 70, and negative voltage supply lead 59B (−14 volts). Diode 77 is connected in the forward bias direction between resistor 74, the positive input to op-amp 70, and voltage supply lead 59A (+14 volts). Capacitor 78 provides low pass filtering to op-amp 70 and is connected between the positive input 70A to op-amp 70 and the ground lead 61. The ground lead 61 is also connects shield 79 on lead 46 to ground.

Op-amp 70 is also connected as a conventional source follower. The single output 81 from co-amp 70 is connected to the negative input 70B, and is applied through lad 82 to the second contact of polarity switch 67.

Figure 4B:
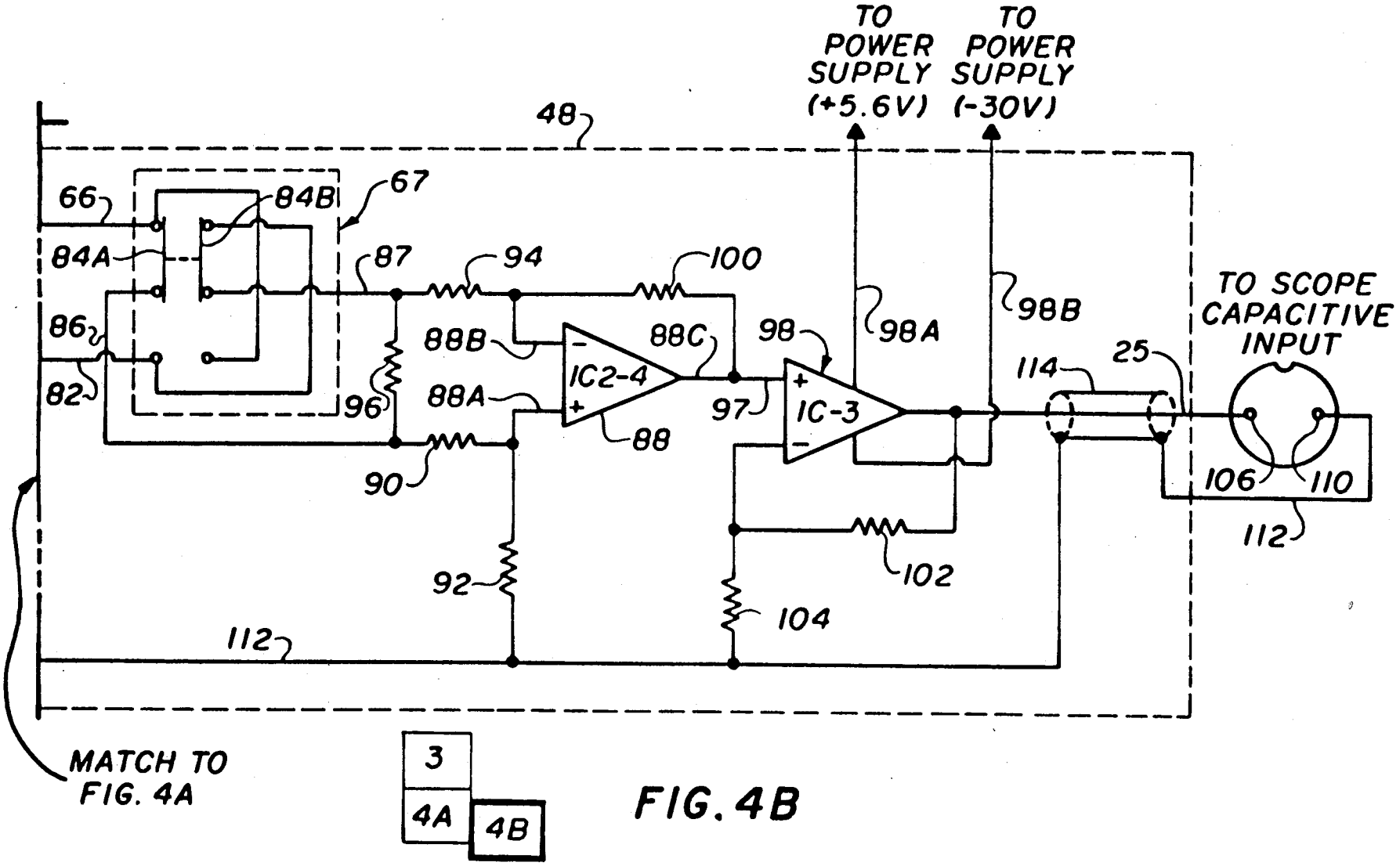

The polarity switch 67 is conventional in design and may, for example, comprise a two-pole two position rocker switch. When the polarity switch is in its first position as illustrated in FIG. 4B, wiper component 84A is connected across leads 82 and 87. The output from op-amp 52 through leads 66 and 86 is applied to the positive input 88A of a differential amplifier 88 through resistor 90. The output from op-amp 70 through leads 82 and 87 is applied t the negative input 88B to the differential amplifier 88 through resistor 84. Resistor 96, connected in parallel with amplifier 88, keeps the output of amplifier 88 at zero voltage during the switching of polarity switch 67.

Alternatively, when the polarity switch 80 is in a second position (not shown), wiper component 84A is connected across leads 82 and 86, and wiper component 84B is connected across leads 66 and 87. The output from op-amp 52 through lead 66 and 87 is applied to the negative input 88B of the differential amplifier 88, while the output from op-amp 70 through leads 82 and 86 is applied to the positive input 88A to the differential amplifier. Accordingly, polarity switch 88 can be moved from the first position to the second position to reverse the polarity of the waveform that enters the differential amplifier 88.

The differential amplifier 88 sums the two waveforms received in the inputs 88A, 88B, and applies a single summed waveform from output 88C through lead 97 to a buffer, indicated generally at 98. The differential amplifier 88 is conventional in design and the gain is controlled by resistors 90, 92 and resistors 94, 100.

The buffer provides an amplified output waveform that is acceptable to an analog oscilloscope. The buffer is conventional in design and includes resistors 102 and 104, which determine the gain of the buffer. The buffer has one pin tied to the power supply (+5.6 volts) through lead 98A, and a second pin tied to the power supply (−30.0 volts) through lead 98B.

The buffered waveform is applied through lead 25 to a capacitive input 106 to the oscilloscope. Terminal 110 to the oscilloscope is typically connected to ground. Shield 114 on lead 25 connects to terminal 110 of the oscilloscope capacitive input and to the ground 112 of the ignition adapter. Resistors 92, 104 are also connected to ground 112 of the ignition adapter.

The two signal pickups 14, 16, through ignition adapter 10, provide the diagnostic oscilloscope with a conventional voltage waveform. The waveform consists of the summed waveforms from the two signal pickups, representing the voltage waveforms in the spark plug leads during the compression and exhaust strokes. If the waveform on the oscilloscope is displayed with a negative polarity, such as when the pickups are incorrectly applied to the spark plug leads, the polarity switch 80 can be set such that the conventional, positive voltage waveform is displayed on the oscilloscope.

To trigger the waveform only on the #1 spark plug firing during the compression stroke, the trigger pickup 20 is applied to the #1spark plug lead, as shown in FIG. 1. The lead 42 from the trigger pickup extends to the trigger circuit 47, as shown in FIG. 2. The trigger circuit comprises similar electrical components and operates in much the same way as the signal processor circuit 48.

Figure 3:
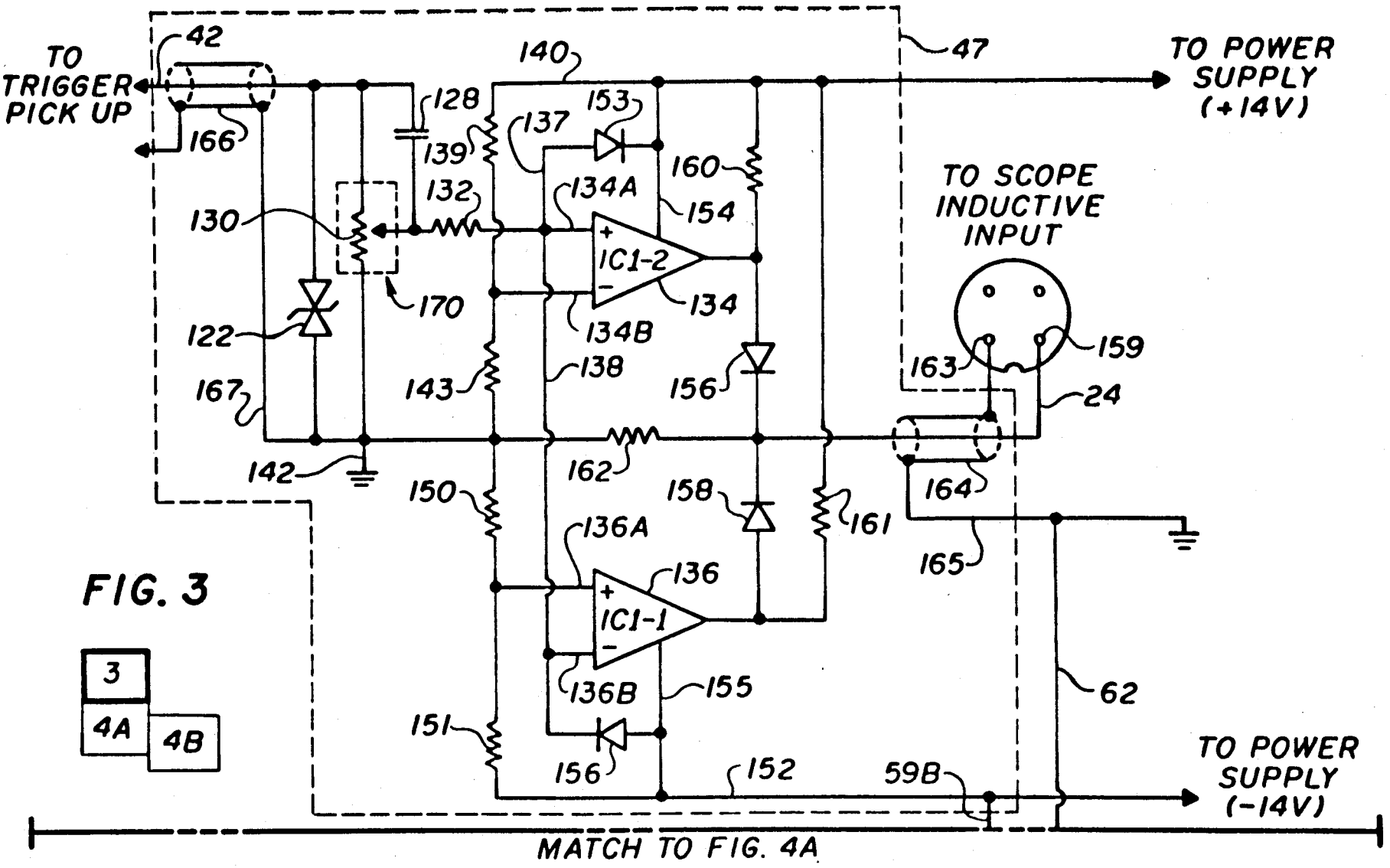
FIG. 3 is an electrical circuit diagram of the trigger circuit component of FIG. 2 constructed in accordance with the present invention.

Specifically, as shown in FIG. 3, the trigger circuit includes movistor 122, capacitor 128, variable resistor 130 and resistor 132. The input from the trigger pickup is applied in parallel to two identical comparators, 134, 136, connected on a dual comparator integrated circuit. Each comparator compares the voltage waveform in the trigger pickup with a selected reference voltage level. When the voltage waveform increases above the reference voltage level, the comparator supplies a voltage pulse to the oscilloscope, which is used to trigger the voltage waveform from the signal pick-ups.

Specifically, the input through lead 42 is applied across movistor 122 and capacitor 128, and through variable resistor 130 and resistor 132 to lead 137 and the positive input 134A to comparator 134. The negative input 134B of comparator 134 is connected by lead 140 to a positive voltage supply (+14V) through a resistor 139. The negative input 134B to comparator 134 is also connected to a ground lead 142 through resistor 143. Resistors 139 and 143 set the threshold level of comparator 134. Finally, comparator 134 has a pin connected through lead 154 to a positive voltage supply (+14v) and lead 155 to a negative voltage supply (−14v). Comparator 134 is protected from voltage surges by resistor 132 and diodes 153, 156.

A portion of the signal from lead 42 is applied through lead 138 to the negative input 136B of comparator 136. Resistors 150, 151 set the threshold level of comparator 136. The positive input 136A to comparator 136 is connected to a negative voltage supply (−14V) through resistor 151 and led 152, and to the ground lead 142 through resistor 150. Comparator 136 is connected to the positive voltage supply (+14v) through led 154, and a negative voltage supply (−14v) through lead 155. Comparator 136 is surge protected by resistor 132 and diodes 153, 156.

The outputs from the comparators 134, 136 are applied to lead 24 through diodes 156, 158 respectively. Lead 24 is connected to an inductive input 159 to the oscilloscope. Diodes 156, 158 are forwardly biased and function to isolate the two outputs of the two comparators. Additionally, resistors 160, 161 are connected to the output of comparators 134, 136, and a positive supply voltage (+14V). Finally, resistor 162 is connected between the cathodes of diodes 156, 158 and the ground lead 142, and provides a zero reference for the lead 24. An inductive input terminal 163 and a shield 164 of lead 24 are connected to ground through lead 165. Additionally, shield 166 on lead 42 is connected to a ground lead 142 through lead 167.

The trigger circuit additionally includes a trigger level adjust, indicated generally at 170. The trigger level adjust comprises knob 35 (FIG. 1) and variable resistor 130 connected as a voltage divider. The variable resistor can be manually controlled by knob 35 on the housing of the ignition adapter to vary the trigger threshold.

The variable resistor 130 is connected as a voltage divider, with the voltage between the wiper and one end of the variable resistor 130 increasing or decreasing depending upon the position of knob 35. Specifically turning the knob 35 in one direction decreases the trigger voltage waveform, effectively increasing the trigger threshold for the circuit. When a positive polarity voltage spike is sensed by the trigger pickup, the negative input to comparator 134 is biased by resistors 139, 143 higher than the peak of the signal waveform received in the positive input of comparator 134 and the output of the comparator will accordingly be low.

When the knob 35 is turned in the other direction, the trigger voltage waveform is increased, which effectively decreases the trigger threshold for the circuit. Consequently, the peak of the signal waveform received in the positive input will be higher than the bias at the negative voltage spikes occurring during the compression strokes are sensed by the pickup 20. Accordingly, the output of comparator 134 will be high, and when applied to the inductive input to the oscilloscope, provides a triggering pulse for the oscilloscope.

Comparator 136 functions in much the same way as comparator 134, but responds to negative polarity voltage signals received in lead 42. When the trigger voltage waveform is decreased, the output of comparator 134 is low. When the trigger voltage waveform is increased, the high voltage levels during the compression stroke begin to switch the comparator 136 high and trigger the oscilloscope.

Further increasing the trigger voltage waveform will begin driving the comparator 134 (or 136) high on both the compression and exhaust stroke voltage levels. Only one-half of the firing patterns will be displayed on the oscilloscope screen. Accordingly, the trigger level can be varied so that the waveform appearing on the oscilloscope is triggered only on the higher voltage levels present during the compression stroke, and not on the lower voltage levels present during the exhaust stroke in the DIS four stroke engine. In this position, the correct number of ignition firings, for example six for a six cylinder engine, will be displayed on the oscilloscope screen.

It is important to note that either a positive or negative polarity waveform from the spark plug lead will trigger the oscilloscope. The positive polarity waveforms will trigger comparator 134, while the negative polarity waveforms will trigger comparator 136. Accordingly, regardless of the polarity of the #1 spark plug lead, the trigger circuit will still function properly. Consequently, the trigger circuit operates independently of the polarity of the signal waveform in the trigger pickup.

The operation of the ignition adapter is as follows. The two signal pickups 14, 16 are clamped to the appropriate spark plug leads from the engine, as described previously. The trigger pickup 20 is then clamped to the #1 cylinder spark plug lead from the engine. The power leads 22 of the power supply circuit are connected to the positive and negative terminals of the vehicle battery 27. Finally, lead 24 is applied to the inductive input to the oscilloscope and lead 25 is applied to the capacitive input to the oscilloscope.

When the engine is running and the oscilloscope is turned on, a waveform appears on the oscilloscope screen which represents the sum of the compression and exhaust stroke voltage waveforms. If the waveform polarity is negative, for example as indicated by the absence of high positive spikes on the screen of the oscilloscope, the operator can use the polarity switch 30 to reverse the polarity of the waveform and obtain a conventional pattern.

The trigger adjust knob 35 is then rotated fully in one direction, which effectively increases the triggering threshold of the trigger circuit above the higher voltage levels present during the compressions stroke. However, the firing pattern on the oscilloscope screen is not synchronized at this time. The knob 35 is then rotated slowly in the reverse direction to get a stable picture with the correct number of spark plug firings, which should be equal to the number of cylinders in the engine.

Rotating the knob 35 in the reverse direction effectively lowers the threshold level so that the circuit is triggered only on the compression strokes. The knob is typically rotated in the reverse direction until only half the spark plug firings are present on the oscilloscope, which indicates that the voltage spikes from both the compression and exhaust strokes are triggering the oscilloscope. Finally, the trigger adjust knob 356 is adjusted in the forward direction to approximately the midpoint between where the stable firing pattern appeared on the oscilloscope and where half the firings appeared on the oscilloscope, to obtain a stable firing pattern of all the spark plugs in the DIS engine.

Accordingly, the ignition adapter provides for displaying a conventional analog waveform on an oscilloscope that represents the spark plug firings in a DIS engine. The display can be manually set to trigger at variable threshold levels, which makes the distributorless ignition adapter uniquely suited for DIS engine systems where there is a higher compression stroke voltage level and a lower exhaust stroke voltage level. The display will be available to service personnel using a simple ignition adapter and by a method that is convenient and accurate. Moreover, the electronics employed in the circuit are relatively simple and inexpensive to purchase and maintain.

A table illustrating the preferred values of the components in the present invention is shown below. It is, of course, within the scope of this invention to select and modify the values listed below:

| RESISTORS | |
|---|---|
| 50 - 100K (maximum) | 104 - 15K |
| | 130 - 10K (maximum) |
| 73 - 100K (maximum) | 132 - 47K |
| 74 - 47K | 139 - 68K |
| 90 - 100K | 143 - 4.7K |
| 92 - 100K | 150 - 4.7K |
| 94 - 100K | 151 - 68K |
| 96 - 100K | 160 - 4.7K |
| 100 - 100K | 161 - 4.7K |
| 102 - 68K | 162 - 47K |
| **CAPACITORS** | |
| 48 - .0033 μf | |
| 60 - 150 pf | |
| 72 - .0033 μf | |
| 79 - 150 pf | |
| 128 - 33 pf | |

Although the invention has been shown and described with respect to a certain preferred embodiment, it is obvious that equivalent alternations and modifications will occur to others skilled in the art upon their reading and understanding of the specification. The present invention includes all such equivalent alternations and modifications, and is limited only by the scope of the following claims.

I claim:

1. An electrical circuit for adapting voltage waveforms in spark plug leads in a DIS four-stroke engine to conventional voltage waveforms for display on a diagnostic oscilloscope, comprising:

a first means for sensing the voltage waveform in a first set of spark plug leads to the engine;

a second means for sensing the voltage waveform in a second set of spark plug leads t the engine;

means for summing the voltage waveform senses in said first and second means;

means for applying said summed voltage waveform to a first input of the diagnostic oscilloscope;

a third means for sensing the voltage waveform in a single spark plug lead;

means for manually varying the amplitude of the voltage waveform sensed in the single spark plug lead;

comparator means for comparing the amplitude of the voltage waveform sensed in the single spark plug lead with a reference voltage; and means for applying a voltage pulse to a second input of the diagnostic oscilloscope when the amplitude of the voltage waveform sensed in the single spark plug lead is greater than said reference voltage.

2. An electrical circuit as in claim 1, further including means for inverting one of the voltage waveforms sensed in said first or second mans for sensing the voltage waveform.

3. An electrical circuit as in claim 2, wherein said single spark plug lead is any spark plug lead in the engine.

4. An electrical circuit as in claim 3, wherein said single spark plug lead is the #1spark plug lead in the engine.

5. An electrical circuit as in claim 4, wherein said comparator means includes first and second comparator means, said first comparator means comparing the amplitude of the positive voltage waveforms sensed in the single spark plug lead to a first reference voltage level, and said second comparator means comparing the amplitude of the negative voltage waveforms sensed in the single spark plug lead to a second reference voltage level, said means for applying a voltage pulse to the second oscilloscope input applying a voltage pulse when the amplitude of the positive waveform is greater than said first reference voltage or the amplitude of the negative waveform is greater than said second reference voltage.

6. An electrical circuit as in claim 5 wherein said means for manually varying the amplitude of the voltage waveform sensed in the single spark plug lead includes variable resistor means.

7. An electrical circuit as in claim 6, wherein said means for summing the voltage waveform includes a switch device and a differential amplifier having positive and negative inputs, and said first and second means for sensing the voltage waveform in the first and second spark plug leads to the engine includes first and second signal pickups, wherein when said switch device is in a first position, the voltage waveform sensed in said first pickup is applied to the positive input of said differential amplifier, and the voltage waveform in said second pickup is applied to the negative input of said differential amplifier, and when said switch device is in a second position, the voltage waveform in said second pickup is applied to said positive input of said differential amplifier and the voltage waveform from said first pickup is applied to said negative input of said differential amplifier.

8. An electrical circuit as in claim 7, wherein said summed voltage is applied to a capacitive input to the oscilloscope.

9. An electrical circuit as in claim 8, wherein said first and second means for sensing the voltage waveform in the first and second set of spark plug leads includes capacitive pickups.

10. An electrical circuit as in claim 1, wherein the DIS four-stroke engine provides a relatively higher voltage waveform in the spark plug leads during a compression stroke, and a relatively lower voltage waveform in the spark plug leads during an exhaust stroke, said means for manually varying the amplitude of the voltage waveform sensed in the single spark plug lead being selectable so that said means for applying a voltage pulse to the input of the oscilloscope applies the voltage pulse to trigger the oscilloscope only when the relatively higher voltage waveform is sensed in the single spark plug lead.

11. An electrical circuit for triggering a diagnostic oscilloscope on the compression stroke of a cylinder in a DIS four-stroke engine, comprising:

means for providing a conventional voltage waveform on an oscilloscope;

means for sensing the voltage waveform in a single spark plug lead to the engine;

means for varying the amplitude of the voltage waveform sensed in the single spark plug lead;

means for comparing the amplitude of the voltage waveform sensed in the single spark plug lead to a predetermined reference voltage and means for applying a voltage pulse to an input to the oscilloscope when the amplitude of the voltage waveform sensed in the single spark plug lead is greater than said reference voltage to trigger the oscilloscope on the compression stroke of the cylinder.

12. An electrical circuit as in claim 11, wherein said spark plug lead is the #1 spark plug led in the DIS four stroke engine.

13. An electrical circuit as in claim 12, wherein said means for comparing the amplitude of the voltage waveform sensed in the single spark plug lead includes a first means for comparing the amplitude of the voltage waveform sensed in the single spark plug lead to a positive reference voltage and a second means for comparing the amplitude of the voltage waveform sensed in the single spark plug lead to a negative reference voltage.

14. A method for adapting the voltage waveforms in spark plug leads in a DIS four-stroke engine to a conventional voltage waveform for display on a diagnostic oscilloscope, comprising the steps of:

sensing the voltage waveforms in a first set of spark plug leads to the engine;

sensing the voltage waveforms in a second set of spark plug leads to the engine;

summing the voltage waveforms from said first and second sets of spark plug leads;

applying aid summed waveform to a first input to an oscilloscope;

sensing the voltage waveform in a single spark plug led;

manually varying the amplitude of the voltage waveform sensed in the single spark plug lead;

comparing the amplitude of the voltage waveform sensed in the single spark plug lead to a preselected referenced voltage; and applying a voltage pulse to a second input to the oscilloscope when the amplitude of the voltage waveform sensed in the single spark plug lead is greater than said reference voltage.

15. A method as in claim 14, wherein the voltage waveform sensed in the single spark plug lead is sensed in the number 1 spark plug led to the engine.

16. A method as in claim 15, wherein the amplitude of the voltage waveform sensed in the number 1 spark plug lead is compared to a negative reference voltage level and a positive reference voltage level.

17. An electrical circuit for adapting voltage waveforms in spark plug leads in a DIS four-stroke engine to conventional voltage waveforms for display on a diagnostic oscilloscope, comprising:

a trigger circuit;

a single processor circuit; and a power supply circuit;

said single processor circuit having means for receiving voltage waveforms from a first and second pickup, means for summing the voltage waveforms received from the first and second pickup, and means for applying the summed voltage waveform to a capacitive input of the diagnostic oscilloscope;

said trigger circuit having means for receiving voltage waveforms from a third pickup, means for comparing the voltage waveform received from the third pickup to a preselected reference voltage level, and means for applying a trigger voltage pulse to an inductive input of the diagnostic oscilloscope when the amplitude of the voltage waveform received from the third pickup is greater than the reference voltage; and said power supply circuit having means for supplying power to the signal processor circuit and the trigger circuit.

18. An electrical circuit for adapting voltage waveforms in spark plug leads in a DIS four-stroke engine to conventional voltage waveforms for display on a diagnostic oscilloscope, comprising:

a first signal pick-up for sensing the voltage waveform in a first set of spark plug leads to the engine;

a second signal pickup for sensing the voltage waveform in a second set of spark plug leads to the engine;

a device for summing the voltage waveform sensed in said first signal pickup and the voltage waveform sensed in said second signal pickup, the summed voltage waveform being applied to a first input of the diagnostic oscilloscope;

a trigger pick-up for sensing the voltage waveform in a single spark plug led to the engine;

an adjustment device for selectively varying the amplitude of the voltage waveform sensed in the single spark plug lead; and a comparator device for comparing the amplitude of the voltage waveform sensed in the single spark plug lead with a preselected reference voltage waveform, the comparator device being capable of applying a voltage trigger pulse to a second input of the diagnostic oscilloscope when the amplitude of the voltage waveform sensed in the single spark plug lead increases above the preselected reference voltage waveform.

* * * * *

UNITED STATES PATENT AND TRADEMARK OFFICE

CERTIFICATE OF CORRECTION

PATENT NO. : 5,132,625

DATED : July 21, 1992

INVENTOR(S) : Alexander Shaland

It is certified that error appears in the above-identified patent and that said Letters Patent is hereby corrected as shown below:

Col. 10, line 35 please delete "t" and insert therefore --to--

Col. 10, line 36 please delete "senses" and insert therefore --sensed--

Col. 10, line 54 please delete "mans" and insert therefore --means--

Col. 12, line 22 please delete "led" and insert therefore --lead--

Col. 12, line 35 please delete "led" and insert therefore --lead--

Col. 13, line 13 please delete "led" and insert therefore --lead--

Signed and Sealed this

Seventeenth Day of August, 1993

Bruce Lehman

*Attest:*

BRUCE LEHMAN

*Attesting Officer*

*Commissioner of Patents and Trademarks*